US005752554A

United States Patent [19]

Campbell

[11] Patent Number: 5,752,554

[45] Date of Patent: May 19, 1998

[54] ADJUSTABLE GASOLINE PUMP TRIGGER RETAINING MECHANISM

[76] Inventor: Scott Campbell, 1601 Montgomery Rd., Allison Park, Pa. 15101

[21] Appl. No.: 805,428

[22] Filed: Feb. 25, 1997

[51] Int. Cl.[6] ..... B65B 3/04

[52] U.S. Cl. ..... 141/392; 251/90; 251/111; D8/349; D8/354; D15/9.1

[58] Field of Search ..... 141/392; 251/90, 251/111; D8/349, 354; D15/9.1; 248/67.7, 68.1, 70, 74.1; 74/526

[56] References Cited

U.S. PATENT DOCUMENTS

| | | | |
|---|---|---|---|
| D. 361,258 | 8/1995 | Helman | D8/354 |
| 2,396,925 | 3/1946 | Morehouse | 248/68.1 |
| 4,623,102 | 11/1986 | Hough, Jr. | 248/68.1 |
| 4,683,923 | 8/1987 | Harris | 141/392 |
| 4,690,182 | 9/1987 | Kraus | 141/392 |
| 4,881,705 | 11/1989 | Kraus | 248/68.1 |
| 4,944,475 | 7/1990 | Ono et al. | 248/68.1 |
| 4,958,791 | 9/1990 | Nakamura | 248/74.1 |
| 5,060,810 | 10/1991 | Jones | 248/68.1 |
| 5,199,474 | 4/1993 | D'Angelo | 141/392 |
| 5,217,054 | 6/1993 | Mollica | 141/391 |
| 5,240,226 | 8/1993 | Bobst | 251/90 |
| 5,423,501 | 6/1995 | Yu | 248/74.1 |
| 5,517,732 | 5/1996 | Crear | 141/392 |
| 5,622,341 | 4/1997 | Stana | 248/74.1 |

*Primary Examiner*—J. Casimer Jacyna
*Attorney, Agent, or Firm*—Kenneth P. McKay, Esq.

[57] ABSTRACT

A retaining device comprising two articulating clamping portions which encompass around a gasoline pump handle frame, depressing and holding the operating handle, thereby fixedly securing the pump trigger to allow dispensing of gasoline without attendance.

1 Claim, 4 Drawing Sheets

ADJUSTABLE GASOLINE PUMP TRIGGER RETAINING MECHANISM

BACKGROUND OF THE INVENTION

1. Field of the Invention

The invention relates to an improved device for use in gasoline dispensing apparatus and in particular, with devices used in customer self service stations, to allow continuous pressure on the dispensing nozzle so that the gasoline tank may be filled without attendance by the party.

2. Description of the Related Art

The current art shows a variety of locking mechanisms for the triggers on gasoline pumping apparatus. In particular the prior art shows trigger retaining mechanisms which work both inside and outside the nozzle handles to retain the trigger such that the dispensing nozzle continuously dispenses the liquid. A variety of devices are used including coils, balls, and a vanity of clamps. With respect to the latter, clamps, prior art shows a host of clamping devices none of which entail the embodiment put forth by the present invention.

A main drawback of the current art is that the past inventions do not accommodate a variety of sizes of nozzle handles. Prior art clamping devices are fixed without articulation around the handle such that they are impractical on a wide variety of handle sizes. Another main drawback of the current art is that the clamping devices may be bumped and jarred such that they will allow a release of the triggers. And, finally, many of the prior art devices are large and unwieldy, and cumbersome to stow readily in an automobile such that they are conveniently available to the user.

The present invention which is the subject of this disclosure and these claims addresses the shortcomings and succeeds in substantially improving thereon.

PRIOR ART

U.S. Pat. No. 5,217,054 (Mollica) describes an actuator to retain the trigger in the form of a spring extending transversely of and supported on the trigger guard and engaging the trigger from inside said trigger guard.

U.S. Pat. No. 5,199,474 (B'Angelo) discloses a device for maintaining the handle of a gasoline pump nozzle in the depressed position by means of a ball which is dimensioned such as to be placed between the operating the handle and the handle frame.

U.S. Pat. No. 4,690,182 (Knaus) shows a device to hold the lever of a nozzle assembly in the opened position by means of a rigid and fixed clamp surrounding the outside of the nozzle handle and the trigger inside the nozzle handle hand guard.

U.S. Pat. No. 4,683,923 (Harris) shows a similar clamp in the form of a clip with serrated rows of teeth along the inner edge of the clamp arms to accommodate various sized nozzle handles.

SUMMARY OF THE INVENTION

The objective of the present invention is to provide a means of affirmatively locking the trigger of a gasoline pump dispensing nozzle such that the dispensing equipment allows the continuous flow of fuel to the gasoline tank. The objective includes the means of accommodating easily a variety of sizes of handles by means of an articulating clamp device.

The Adjustable Gasoline Pump Trigger Retaining Mechanism comprises a pair of opposing and articulating portions, connected on one end with a pivoting means and interlocked on the opposing end with a fastening means whereby the portions are then encompassed around the handle frame of a gasoline pump and holding the operating handle, thereby being locked in place while fuel is being dispensed.

The invention, in its preferred embodiment, includes a pivoting means made of a bolt and bushing assembly which allows for the frequent and repetitive operation of the invention without substantial wear. The upper and lower portions are molded from plastic or can be fabricated from other durable, inexpensive material. The fastening means in the preferred embodiment comprises a row of parallel serrated teeth on one portion which interfaces with a retention pin on the opposing portion. The retention pin thereby interlocks adjustably into a single serration point, closing and securing the retaining mechanism around the handle frame while depressing the operating handle.

DETAILED DESCRIPTION OF THE PREFERRED EMBODIMENT

Figure 1:
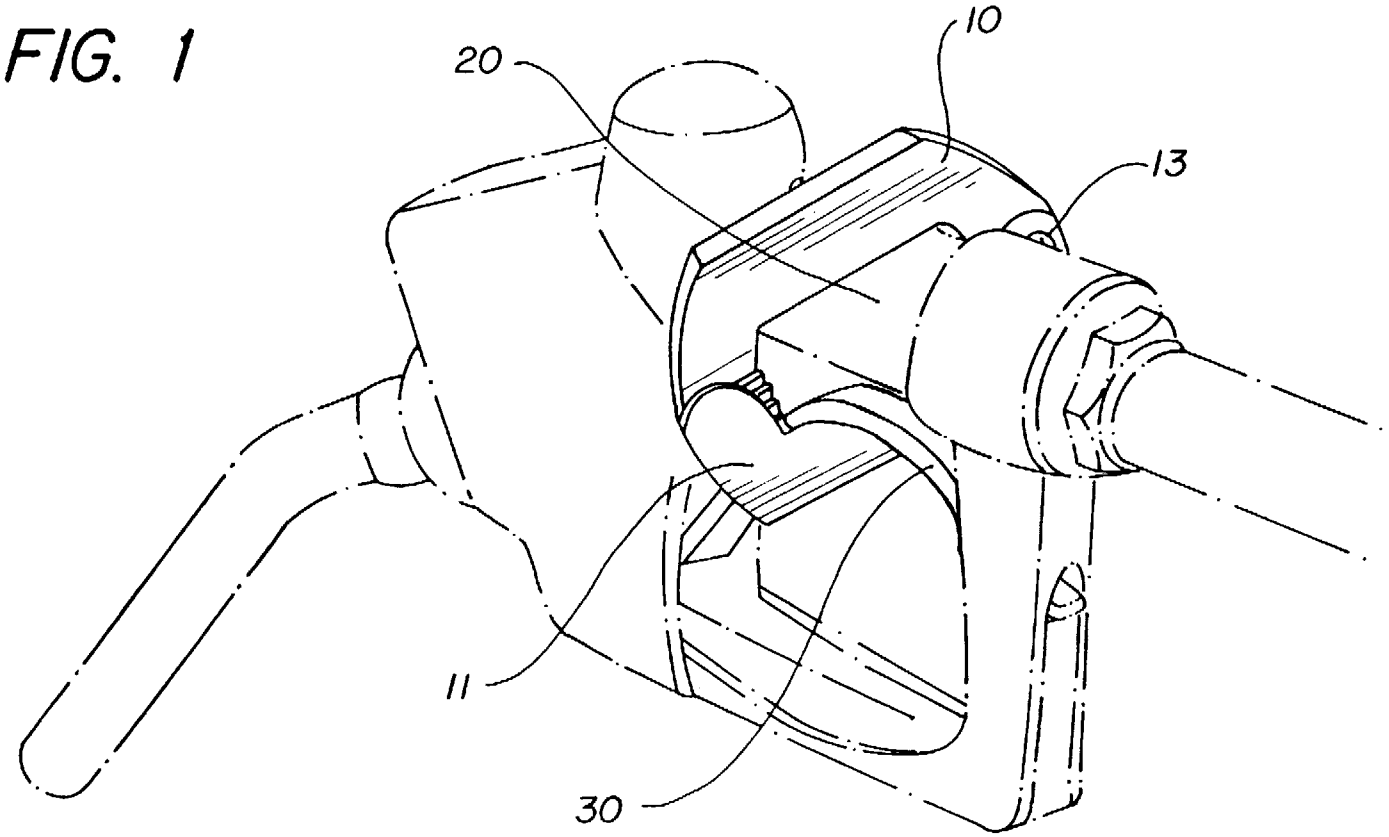
FIG. 1 is a perspective view of the Adjustable Gasoline Pump Trigger Retaining Mechanism showing the invention encompassing a gasoline pump dispensing nozzle handle frame to depress the operating handle in the open position, thereby allowing for the flow of gasoline.

FIG. 1 shows the subject invention in its clasped form whereby the engaged portion 10, is connected to the engaging portion 11, around the handle frame 20 thereby depressing the operating handle 30 to dispense gasoline. The engaged portion 10 is rotatably connected to the engaging portion 11, by a pivot means 13.

Figure 2:
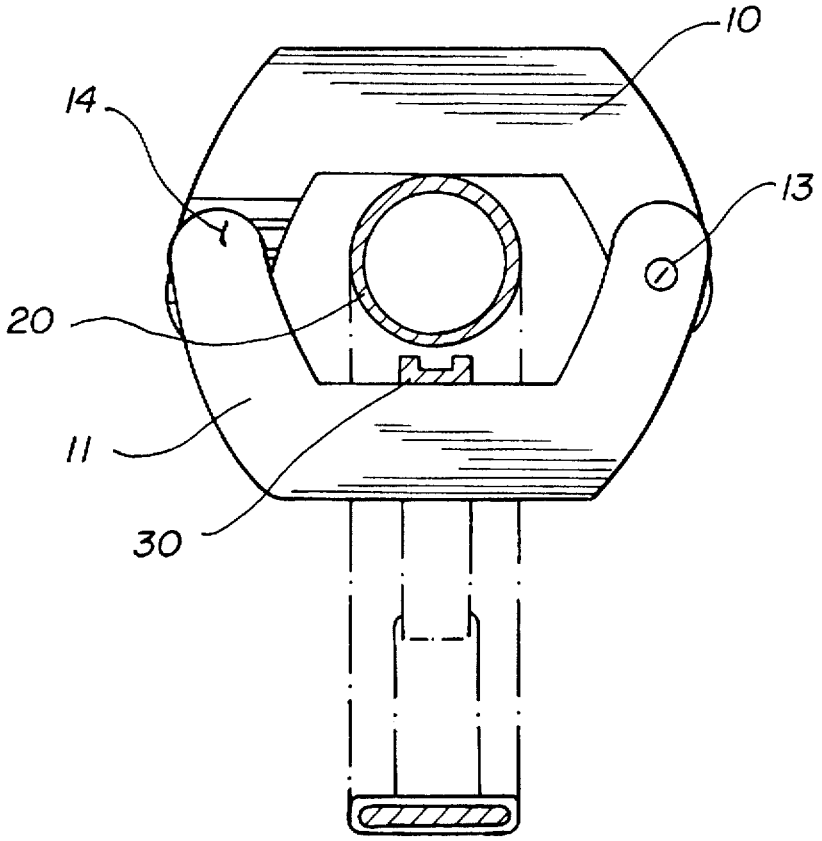
FIG. 2 is a is a view of the device as a section through the gasoline pump dispensing nozzle handle frame.

FIG.2 shows the sectional view of the invention in its clasped form. An adjustable fastening means 14, provides for the fastening of the engaged portion 10 to the engaging portion 11, around the handle frame 20, at ends opposed to the pivoting means 13. Adjustable fastening means 14 is constructed by providing for an engaging means 15 on the engaging portion 11, which provides a retainer for an adjustably engaged means 16 on the opposing engaged portion 10.

Figure 3:
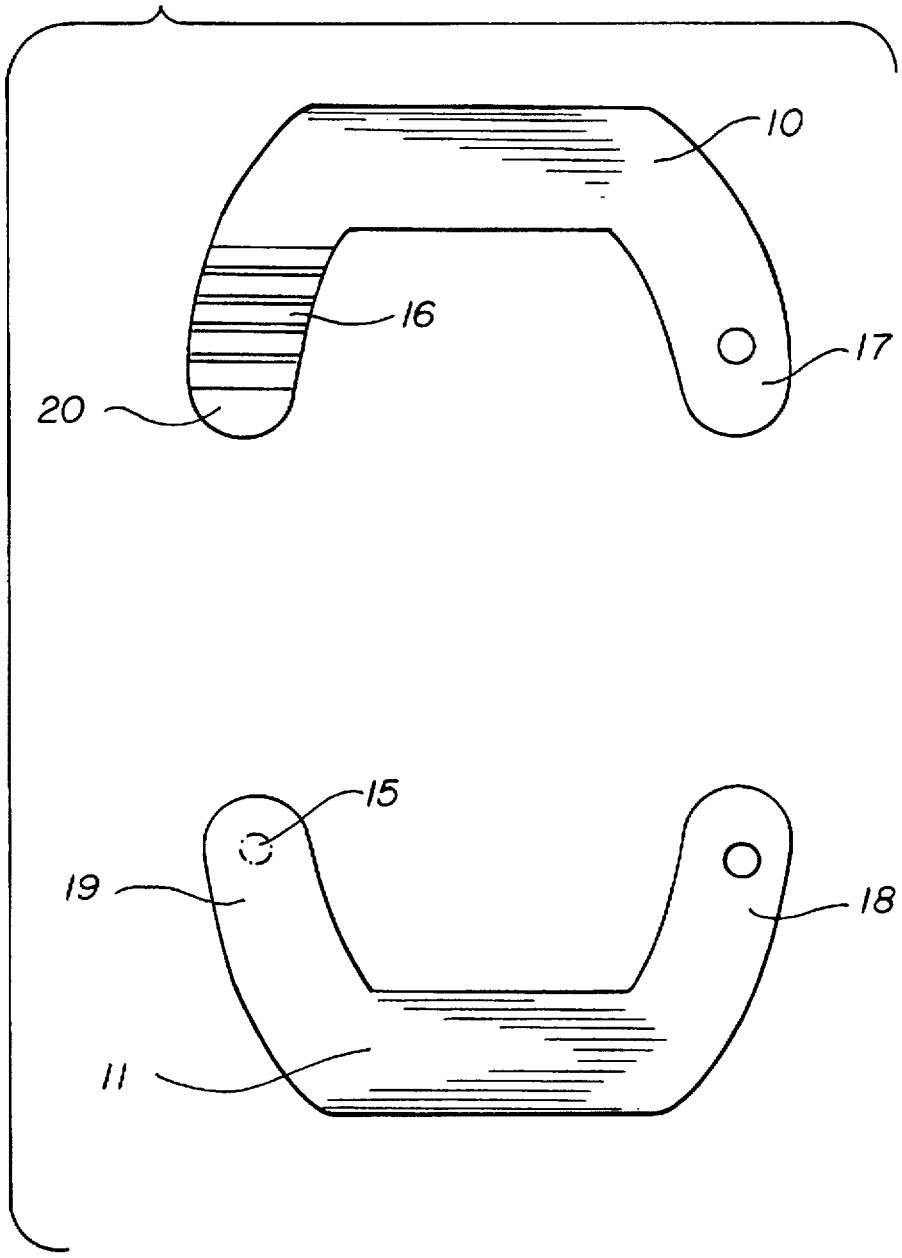
FIG. 3 is a view of the disassembled device showing opposing portions without pivoting means installed.

FIG. 3 demonstrates the disassembly of engaged portion 10 and the engaging portion 11, without the pivoting means 13 installed. Pivoting end 17 of engaged portion 10 is fashioned with a hole, as is also contained in the opposing pivoting end 18 of the engaging portion 11. Likewise, there is an engaging means 15 at the opposite end of the engaging portion 19, and an adjustable engaged means 16 at the opposite end of the engaged portion 20.

Figure 4:
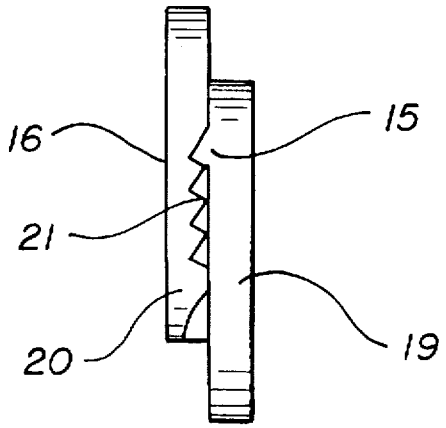
FIG. 4 shows a view of the device in its preferred embodiment having a fastening means of serrated teeth and retention pin.

FIG. 4 shows a sectional view of the preferred embodiment of the adjustable fastening means 14. In the preferred embodiment, the adjustably engaged means 16 is comprised of a multitude of parallel aligned serrated teeth 21 whereby the engaging means 15 is a single retention pin which is retained in an adjustable manner within the adjustable engaged means 16, depending on the thickness of the handle frame 20. This will cause the engaging means 15 to be retained in a different serrated tooth on the adjustable engaged means 16.

Figure 5:
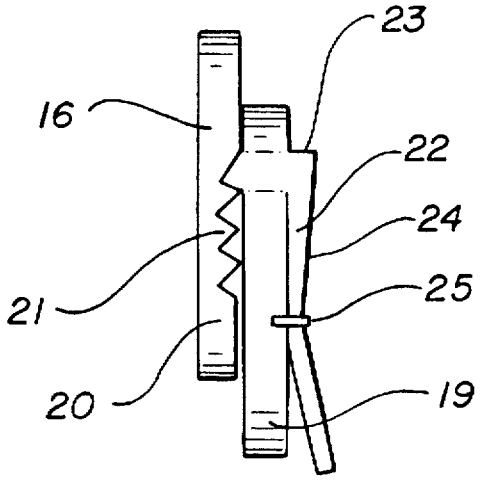
FIG. 5 shows a view of the device in its alternative preferred embodiment having a fastening means of serrated teeth and an L-shaped retractable lever.

FIG. 5 shows a sectional view of the alternate preferred embodiment of the adjustable fastening means 14. In this embodiment, the engaging means 16 is an L-shaped retractable lever 22 with a perpendicular side 22 and an acting end 23. The retractable lever 22 is connected to the engaging portion 11 by any rotatable fastener 25. The acting end 23 slides through a hole cast or drilled through the engaging portion 11. Depression of the perpendicular side 22 disengages the acting end 23 from the serrated tooth 21.

What claimed is:

1. A retaining mechanism for depressing and holding the operating handle of a gasoline pump within the handle frame, comprising:

a. a flat, half-ellipsoid shaped engaged portion with a pivot end and a connection end, having a hole within said pivot end and a multitude of parallel serrated teeth on said connecting end;

b. a flat, half-ellipsoid shaped engaging portion with a pivot end and a connection end, having a hole within said pivot end and a hole within said connection end, said hole in said pivot end of said engaging portion being concentrically aligned and overlapping said hole within said pivot end of said engaged portion;

c. a bolt installed through said hole in said pivot end of said engaged portion and through said pivot end of said engaging portion, and having a nut threaded thereon said bolt, and having a bushing disposed between said nut and said engaged portion whereby said lateral play is accommodated, and whereby said bolt allows said engaged portion to articulate and thereby encompass said handle frame and said operating handle and be held thereon by the interlocking of said adjustable engaged means with said engaging means, said bolt having sufficient lateral play in its design and manufacture whereby it shall allow lateral deflection of said engaged portion with respect to said engaging portion such that respective connecting ends shall engage; and, d. an L-shaped retractable lever, said L-shaped retractable lever having an acting end and a perpendicular side, said acting end being disposed through said hole in said engaging portion and being adjustably retained within any of said serrated teeth and said perpendicular side being pivotally fastened about said engaging portion whereby depression of said perpendicular side disengages said acting end from said serrated tooth.

* * * * *